US005540172A

United States Patent [19]

Goldbach et al.

[11] Patent Number: 5,540,172

[45] Date of Patent: Jul. 30, 1996

[54] APPARATUS FOR PERFORMING EXTERNAL SURFACE WORK ON UNDERSIDE OF SHIP HULL

[75] Inventors: Richard A. Goldbach, Norfolk, Va.; John R. Salzer, Sugar Land, Tex.

[73] Assignee: MMC Compliance Engineering, Inc., Norfolk, Va.

[21] Appl. No.: 405,021

[22] Filed: Mar. 16, 1995

[51] Int. Cl.[6] ..... B63B 59/06

[52] U.S. Cl. ..... 114/222; 451/3; 451/92

[58] Field of Search ..... 114/222; 451/2, 451/3, 92

[56] References Cited

U.S. PATENT DOCUMENTS

| | | | |
|---|---|---|---|
| 2,528,809 | 11/1950 | Young | 114/222 |
| 3,864,876 | 2/1975 | Diehn | 114/222 |
| 3,906,673 | 9/1975 | Goto et al. | 451/92 |
| 4,092,942 | 6/1978 | Kurohiji et al. | 114/222 |
| 4,445,451 | 5/1984 | Van Den Broek | 451/92 |
| 5,138,800 | 8/1992 | Janusz | 451/92 |
| 5,211,125 | 5/1993 | Garland et al. | 114/222 |
| 5,353,729 | 10/1994 | Goldbach et al. | 114/222 |
| 5,398,632 | 3/1995 | Goldbach et al. | 114/222 |

FOREIGN PATENT DOCUMENTS

| | | | |
|---|---|---|---|
| 219194 | 11/1985 | Japan | 114/222 |

*Primary Examiner*—Sherman Basinger

*Attorney, Agent, or Firm*—Cushman Darby & Cushman, L.L.P.

[57] ABSTRACT

For abrasively blast-cleaning the bottom of a ship hull while the ship is supported on blocks on the floor of a drydock, an upwardly facing closed cycle abrasive wheel having a durable but compliant seal projecting forwards around its frontal perimeter, is mounted for transversal movement along the moderately articulatable rails of a mobile carrier. A control panel is provided for effecting traversal, for controlling spraying of abrasive, for controlling X-Y movement of the carrier along the drydock floor, and for extending and retracting rail end support jacks of the carrier frame for locally conforming the vertical positioning of rail ends to the bottom of the ship.

24 Claims, 10 Drawing Sheets

APPARATUS FOR PERFORMING EXTERNAL SURFACE WORK ON UNDERSIDE OF SHIP HULL

BACKGROUND OF THE INVENTION

The U.S. patent of Garland et al., U.S. Pat. No. 5,211,125, issued May 18, 1993, relates to an apparatus and a method for performing external surface work on generally vertical sidewall areas of a ship hull. Typical of the work to be conducted is blast-cleaning, and painting of those areas of a ship hull. Various elaborations and modifications to the apparatus and method are disclosed in the U.S. patent application of Goldbach et al., Ser. No. 08/027,802, filed Mar. 3, 1993, now U.S. Pat. No. 5,398,632, and in the U.S. patent application of Goldbach et al. Ser. No. 08/099,434, filed Jul. 30, 1993 now U.S. Pat. No. 5,353,729.

In general, the above-identified U.S. patent and applications disclose placing towers along at least a portion of the sidewall of a ship (while the ship is in drydock or afloat), and enshrouding the tower or towers against the hull, to create an enclosed spaced, which is ventilated by means of an air-processing system. The air-processing system heats and conditions the air being supplied to the enclosed space, and extracts dust and volatile organic chemicals from the air exhausted from the enclosed space.

Work on the hull is accomplished within the enclosed space, from a platform mounted to a vertically elevatable trolley supported on a respective tower. During cleaning operations, the output of a blast cleaning device is applied from the platform against a respective increment of the ship hull. During painting operations, a paint spraying device is applied from the platform against a respective increment of the ship hull.

Although much of the sidewall of a ship hull is substantially vertical, compound curvature is exhibited in bow and stern areas, and even amidship the exterior surface curves under at the sidewall base, from vertical to horizontal. Much of the exterior surface of the bottom of a ship hull is generally or substantially horizontal (particularly if the ship is in the economically significant class of bulk cargo vessels, such as very large crude carriers).

The above-identified U.S. patent and applications disclose, among them, a way of applying surface work in the curved bow, stern and sidewall base (or bilge) areas of the ship hull sidewall. An important part of this way of accommodating carrying out the process to the fact of curvature in those areas, is that the work platform is mounted to the trolley by a set of arms which are extensible and retractable towards and away from the trolley so that where the hull curves away from the respective tower, the arms can be extended (differentially relative to one another, if need be), for always maintaining uniformity in the spacing of the work platform from the particular increment of ship hull sidewall being worked on, regardless of whether that increment is part of a large substantially vertical area, or is part of a transitional area where the hull is curving away from the tower.

The shrouding for the tower or towers includes not only portions which extend around the rear and sides of the tower or set of side-by-side towers, and over the top, but also portions which seal with the support surface on which the tower or towers are supported (e.g., a drydock deck if the ship is in drydock, or an alongside barge if the ship is afloat while being worked on). Further, at the left and right ends of the enclosure, the shrouding extends forward to seal against the ship hull sidewall surface, e.g., with the aid of a batwing-like skeletal framework for flexible plastic fabric sheeting having magnetic grippers secured along its leading edge. At the base of the sidewall, at the limit where the hull exterior surface curves away too radically towards horizontality to be able to be effectively worked on using the above-described tower based apparatus (or near the waterline, in the case of a ship afloat), the prior art system referred to above provides the shrouding with a bib-like lower frontal curtain element which defines the lower frontal part of the confined space of the tower or set of towers. The upper edge of the curtain is similarly attached and sealed to the hull, and the lower or rear edge is sealed to the tower support surface, left and right edges are integrated into the left and right end curtains for the shrouding.

Accordingly, paint chips, metal flakes, spent abrasive, paint overspray and the like can be kept from falling into, or being washed by rain into the water in the vicinity of the work being done on the ship hull.

The above-identified U.S. patent and patent applications further disclose, among them, ways and means for recovering spent abrasive, separating it from paint chips and other debris as well as from used-up spent abrasive (i.e., which has become too size-reduced and/or rounded in particle shape), and recycling the portion of it which is reuseable, together with make-up unused abrasive grit, to the abrasive blasting applicator devices.

Abrasive blasting applicator devices which are closed-cycle are known in the art, and are referred to and further identified in the above-identified U.S. patent and patent applications. In such a device, the output nozzle or equivalent structure of the device is surrounded around the rear and sides, by a forwardly extending structure, the effective forward edge of which forms a trap against the surface being blast cleaned, so that much of the spent abrasive, paint chips, scale and the like which rebound from or are blasted free of the work surface, rather than falling to the deck or other undersurface, are caught within the trap, and either funnelled to a collector for separation and recycling back to the blast applicator device, or for a plurality of cycles, may simply be recycled, without substantial separation, within the device, until the grit has become too size-reduced and too adulterated with paint chips and scale, whereupon, the contained supply of grit of the particular blaster is wholly or partly replaced with fresh abrasive grit.

The above-identified U.S. patent and applications further disclose, among them, that whereas in some instances, the work-applying device such as an abrasive blaster or a paint sprayer, can be a hand-held unit being supported and manipulated by a human operator standing on the elevatable platform of a respective shrouded tower, in other instances, the work applicator is mounted on a carriage that is movable along rails extending in a left-to-right direction on the front and/or bottom of the elevatable platform. Indexing of the carriage along the platform can be under automated control, off-platform (remote) manual control and/or on-platform manual control (e.g., by a human operator operating the controls of a control panel).

Cleaning and painting of ship hulls and the like, using apparatus such as that described above as practiced by MMC Compliance Engineering, Inc. of Norfolk, Va., U.S.A., and the apparatus used, are called a CAPE™ system, by that company.

Although some of the same principles would be understood by a person of ordinary skill in the art, no doubt to be applicable to cleaning the generally or substantially horizontal, downwardly facing external surface of a ship hull in drydock, or similar structure, the above-identified U.S. patent and applications do not focus on cleaning such areas, or particularly show or describe ways and means for working on such surfaces.

Working on such a surface, particularly for blast cleaning it, presents unique handling problems associated with the weight of a preferred rotating wheel-type closed cycle abrasive blasting grit applicator, leakage of abrasive rebounding from the work, supporting and moving the applicator along successive swaths of the underside of the bottom of the hull.

SUMMARY OF THE INVENTION

For abrasively blast-cleaning the bottom of a ship hull while the ship is supported on blocks on the floor of a drydock, an upwardly facing closed cycle abrasive wheel having a durable but compliant seal projecting forwards around its frontal perimeter, is mounted for transversal movement along the moderately articulatable rails of a mobile carrier. A control panel is provided for effecting traversal, for controlling spraying of abrasive, for controlling X-Y movement of the carrier along the drydock floor, and for extending and retracting rail end support jacks of the carrier frame for locally conforming the vertical positioning of rail ends to the bottom of the ship.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
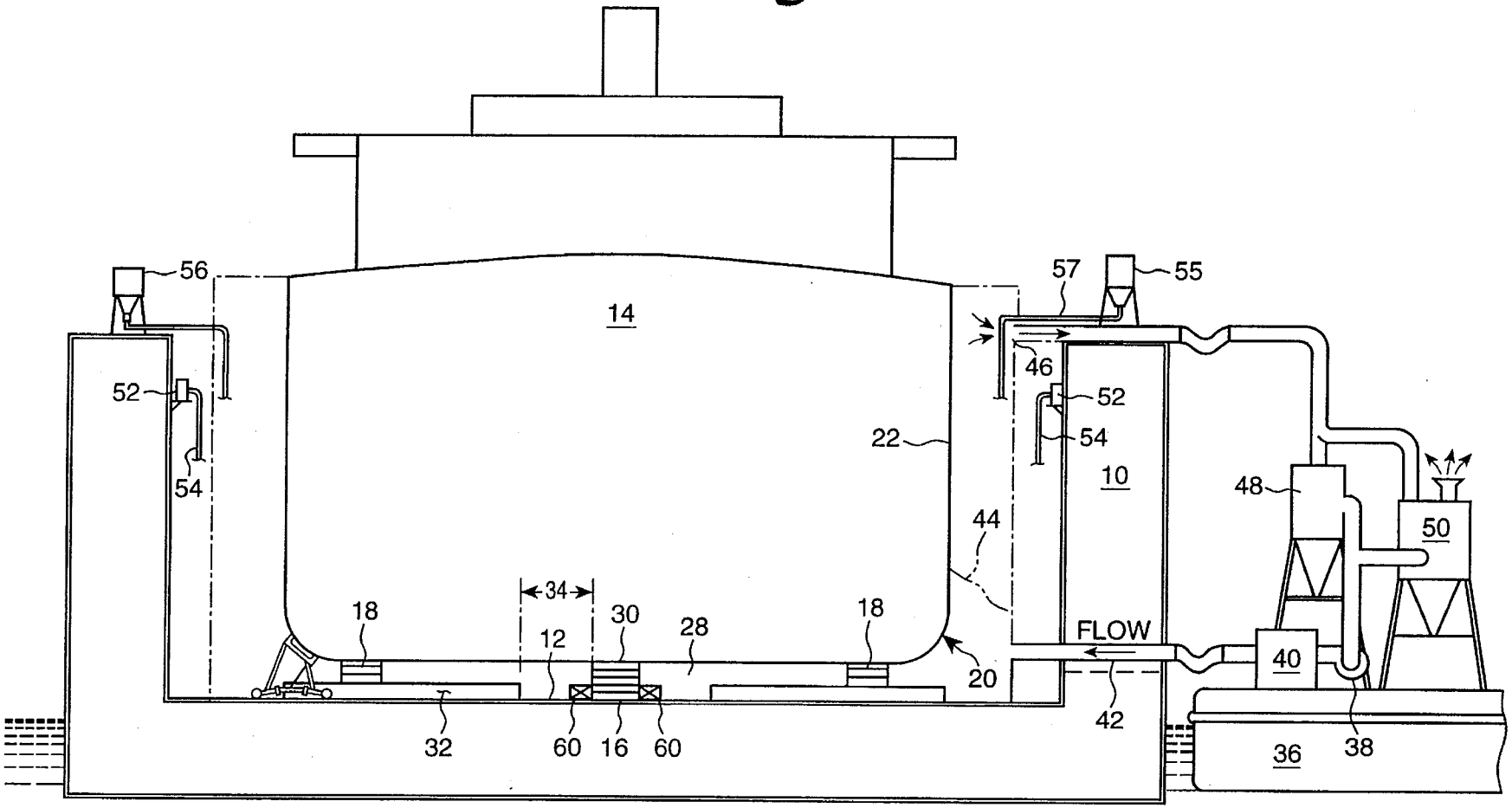
FIG. 1 is a small scale pictorial view showing a ship in drydock, having an increment of its bottom being externally blast-cleaned using an upwardly facing closed cycle abrasive grit-propelling wheel unit supported on a mobile carrier, enclosed within a shroud-confined space served by an air-management system, all in accordance with a preferred embodiment of the present invention.

A pictorial view of apparatus for practicing a preferred embodiment of the invention is illustrated on a small scale in FIG. 1, in order to give interested readers an overview for facilitating their understanding of a typical site.

In FIG. 1, a drydock is shown at 10, having a floor 12 between its upstanding starboard and port wing walls. On this drydock floor, a ship 14 is shown supported in an upright condition at a given elevation above but adjacent the floor 12, a keel block (or keel blocks) 16, and bilge blocks 18. The transitional regions 20 at the bases of the sidewalls 22 of a ship's hull 24, where the outer surface 26 of the hull changes in spatial orientation from being substantially or predominately horizontal on the ship's bottom 28, to being substantially or predominately vertical are known among many professionals in the fields of ship building, repair and operations, as being its bilges. Therefore, the cribbing or other supports which support the ship bottom adjacent these transitional regions are often called bilge blocks. The keel 30 of the ship runs medially along its longitudinal centerline at the bottom, so the cribbing or other supports which support the ship bottom beside and/or under the keel are often called keel blocks. The bilge blocks typically are made up of discrete block elements spaced longitudinally from one another longitudinally along the ship under the bottom at or beside each bilge. The keel block or blocks can be one unitary element, or a succession of elements placed in one or more lines extending longitudinally of the ship.

In a typical practice of the process, the ship bottom is substantially horizontal, and the keel block and bilge blocks are sized and positioned to support the bottom 28 sixty-eight inches (173 cm) above the floor 12 of the drydock, measured beside the keel, and seventy-six inches (193 cm) above the floor 12, measured at the bilge blocks, there usually being a slight pitch in the transverse direction to the ship's bottom. The ship hull in this example measures 41.7 feet (127 meters) from longitudinal centerline at the keel, to the vertical plane of either sidewall, and the ship is a very large crude carrier or other bulk cargo vessel (although the invention is not limited to use on such ships).

Figure 10:
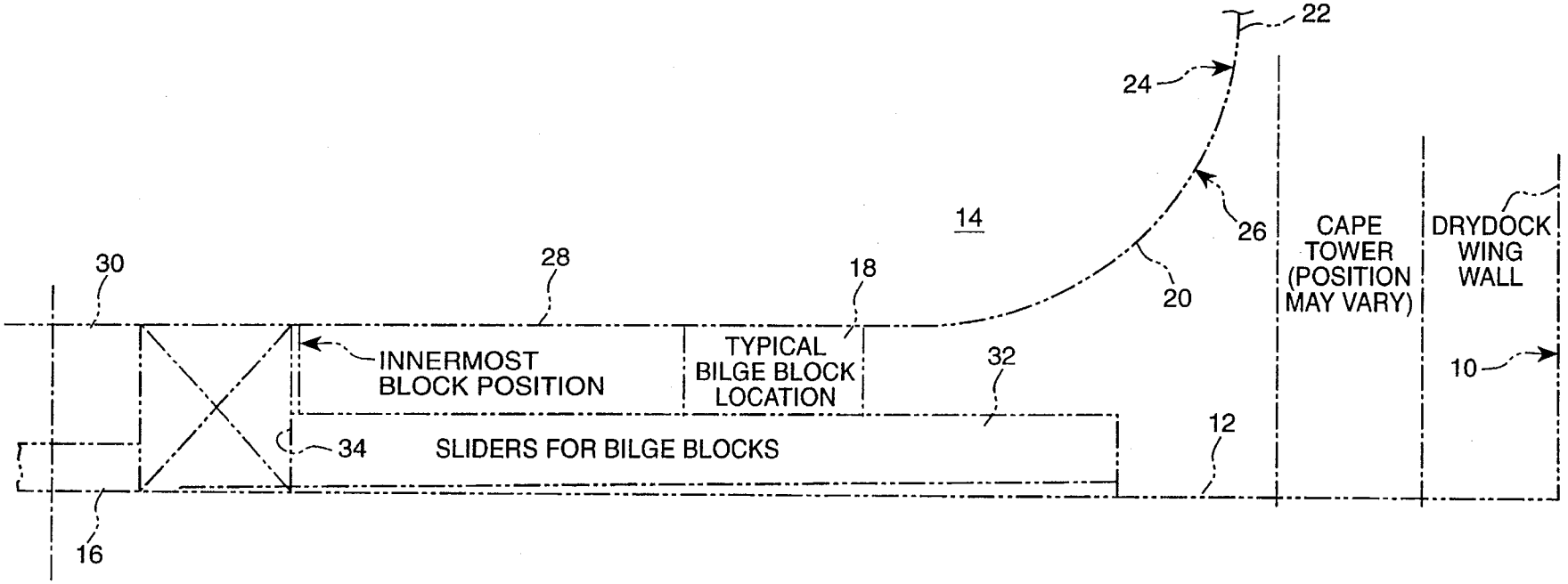
FIG. 10 illustrates schematically in fragmentary front elevation a possible drydock floor layout in which sliders for bilge blocks extend athwartships.
Figure 11:
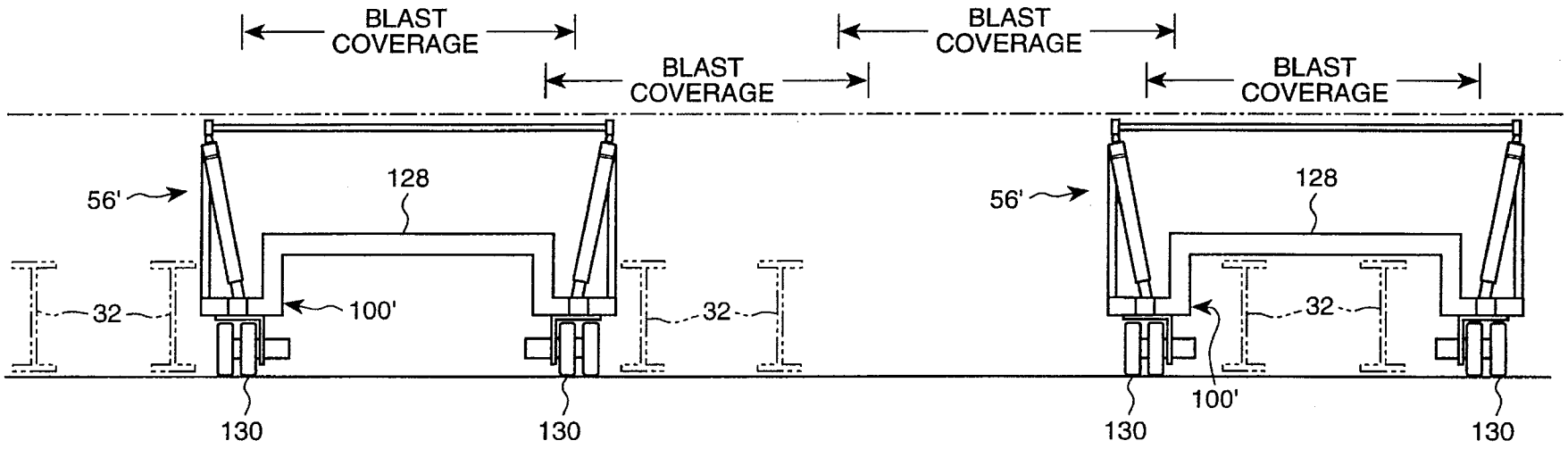
FIG. 11 shows in fragmentary side elevation a modification of the frame of the mobile carrier (two of which are shown), for accommodating traversal athwartships, both between two neighboring sets of sliders, and straddling one set of sliders.

In some typical installations, the keel block directly rests on the drydock floor, and the ship's keel directly rests on it, with other support blocks being snugged against both flanks of the keel, between the drydock floor and snip bottom. Although the bilge blocks also can extend vertically all of the way between the drydock floor and the ship's bottom, e.g., at sites located about two-thirds of the way from the keel centerline towards the vertical planes of the sidewalls of the ship. However, it is also typical (as shown in FIGS. 10 and 11) for there to be rows of sliders 32, i.e., beams or rails laid in a predetermined array, e.g., in pairs extending athwartships on each side of the keel, with some spacing of their most medial ends 34 from the keel block or blocks 16, so as to provide respective longitudinal corridors. In such an installation, the bilge blocks 18 are supported on the sliders 32 so that they may be adjusted in position transversely of the bottom of the ship. The present invention is equally applicable to installations regardless of whether the bilge blocks directly rest on the drydock floor, or indirectly rest on the drydock floor via the sliders. Likewise, each block (as is conventional) need not be an integral, homogenous member, but can be an assemblage of cribbing members for achieving desired objectives of size, position and durability.

In preferred practices of the invention, the process of blast-cleaning the underside of the ship's bottom can be carried on in conjunction with blast cleaning of the ship's hull sidewall exterior surface using the apparatus and processes disclosed in the above-identified U.S. patent and applications. Thus, if a section, e.g., a quadrant, of the sidewall is being worked on using a set of towers ranked side by side, the bib portion and end portions of the tower-enclosing shroud (i.e., curtains) of the apparatus for working on the sidewall section (or extensions of those portions), can serve (together with the keel block or blocks 16) to provide enclosing shrouds or curtains, extending between the underside of the ship hull and the floor of the drydock, for perimetrically enclosing an adjoining section of the underside of the ship's bottom as an enclosed space 44. The curtains can be made of the same materials, supported, fastened and sealed against the floor and bottom in the same ways and by the same means that are disclosed in the above-identified U.S. patent and applications.

In a preferred practice of the invention, the apparatus used also includes an assemblage of support equipment, which may be sited wholly or partly on land, but is preferably mostly, if not wholly, supported on a support barge 36 which can be moored alongside the drydock 10 (which, typically, is a floating drydock). The support equipment preferably includes an air handling system including a pump 38 for circulating air, a heater-humidity adjuster (e.g., a gas-fired or oil-fired air heater 40), a first conduit 42 for supplying the enclosed space 44, a second conduit 46 for exhausting the enclosed space and leading the exhausted air to a particulate removal apparatus 48 (e.g., a cyclone separator for removing airborne abrasive particle fragments and paint chip and scale fragments and paint overspray particles) from the return air stream, and preferably also a volatile organic chemical ("VOC") incinerating apparatus 50. The cleaned air can be exhausted to atmosphere, and/or wholly or partly recycled to the intake side of the pump 38. In case of at least partial recycling of the air stream (which is preferred), the air heater 40 can be wholly or partly merged in structure and/or function with the VOC incinerator 50.

Further, the support equipment preferably includes a supply 55 of abrasive grit, a pressurized supply conduit 57 for supplying abrasive grit to the blaster or blasters (described below) in the enclosed space 44), a return conduit and/or conveyor for returning spent abrasive, likely contaminated by a burden of paint chips and scale, from the catching means of the blaster or blasters, and a cleaner (e.g., a cyclone separator, magnetic separator and/or the like) for generating and recycling to the supply 56 the reuseable fraction of abrasive grit. The abrasive grit can be steel shot, steel fragments, corundum, agate, or the like, such as is conventionally used for abrasive blasting of rusted, scale-bearing and/or painted steel plate.

The support equipment used in practicing the present invention can be duplicative of, or shared in common with the support equipment being used in the cleaning and/or painting of the primarily vertical portions of the ship's hull exterior surface in accordance with the methods disclosed in the above-identified U.S. patent and applications. To that end, the support equipment can also include further apparatus, e.g., a paint supply 52, and a pressurized supply conduit 54 for supplying paint to one or more paint sprayers which can be used within the enclosed space 44 for coating (or recoating) the ship bottom underside that has been cleaned using the process and apparatus of the present invention.

Apparatus for practicing the present invention importantly includes a mobile carrier 56 for apparatus for performing external surface work on the underside of the ship hull. The carrier 56 preferably is used for supporting and controllably positioning an abrasive blaster 58 although it can also be used or alternatively be used for supporting and controllably positioning a tool which applies other work, e.g., spray painting, or welding.

The mobile carrier and abrasive blaster are described below in more detail with reference to FIGS. 2–9 (with two variations being described above and below with reference to FIGS. 10–12).

An abrasive blaster is shown at 58. A commercially available semi-portable recycling shot-blasting wheel can be used. A presently preferred unit is available from Nelco, located in Oklahoma City, Okla., U.S.A. Using it pointed upwards, rather than sideways, is believed to be uprecedented. Although not shown in detail in the drawings, the preferred blaster deposits a received stream of abrasive grit onto the outer rim of a rapidly rotating wheel, which throws this grit by centrifugal force forwardly out through a frontal opening 60 of the housing 62 of the blaster.

Preferably, two structural modifications are made to the commercially available blaster for adapting it for use in practicing the present invention, namely, a seal structure is provided around the frontal opening 60, and means are provided for movably supporting the blaster on the mobile carrier 56.

Figure 7:
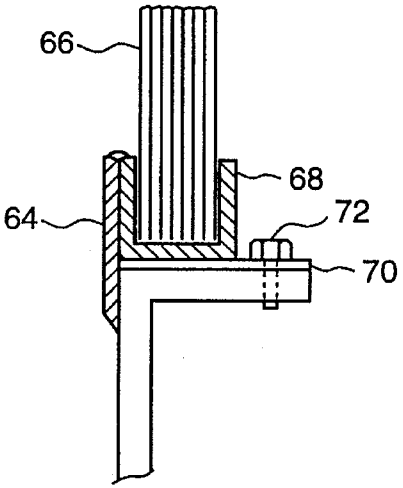
FIG. 7 is a fragmentary cross-sectional view taken on the line 7—7 of FIG. 6.
Figure 6:
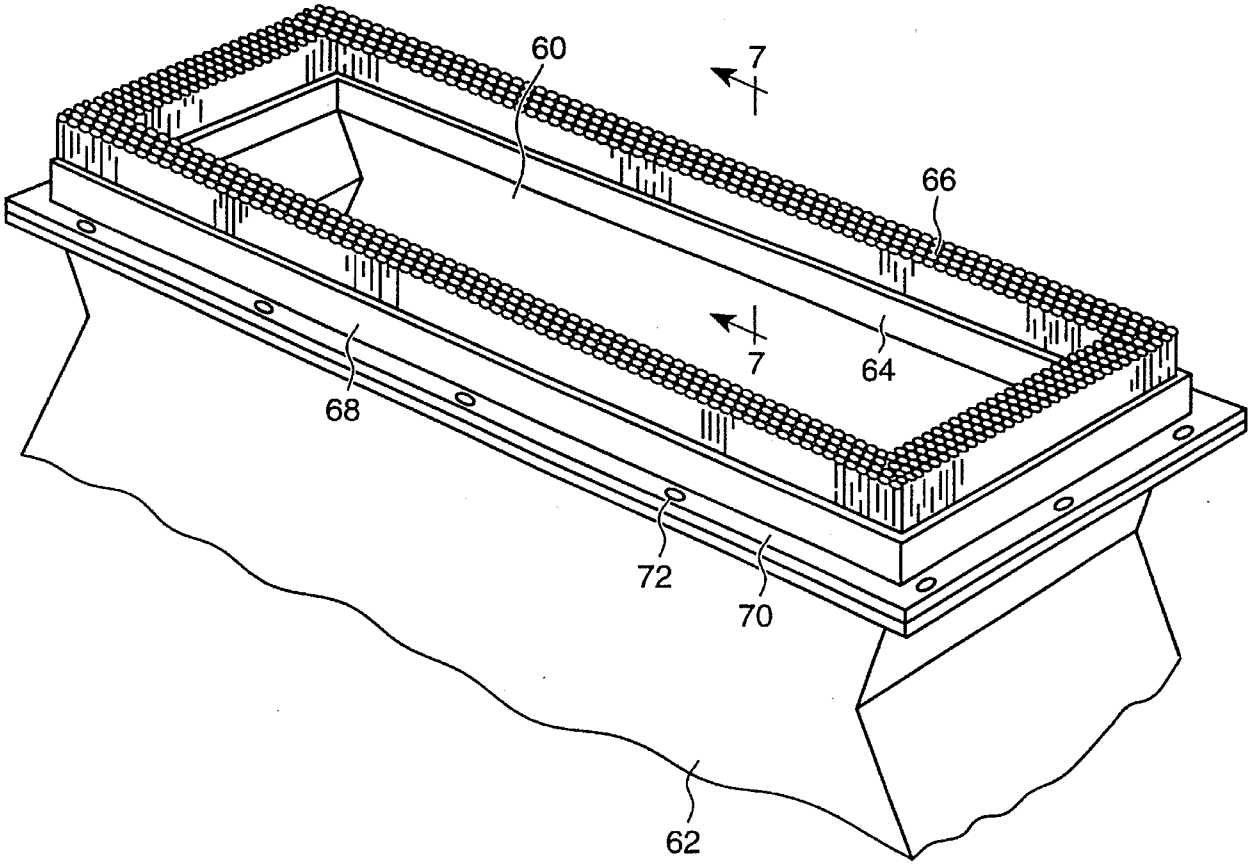
FIG. 6 is a fragmentary perspective view of the frontal side of a closed cycle abrasive blaster provided with a sturdy compliant seal in accordance with the preferred embodiment of the invention.

The seal structure, as shown in most detail in FIGS. 6 and 7, includes a rectangular wear shield 64 which lines the inner perimeter of the mouth 60 of the blaster housing 62 and projects forwardly out of the mouth. It is ringed by a forwardly projecting brush seal 66 socketed in a channel 68. Both the wear shield and the brush seal channel are secured to one another and to a mounting flange 70 shown perimetrically bolted at 72 to the housing 62 around the opening 60. By preference, the brush seal is made of Kevlar® polyaramid fabric sheets or boron fibers, or any other suitable flexible, durable material, and preferably the wear shield and brush seal channel are made of consolidated boron fiber or ballistic steel.

In use, the brush seal is jammed forwards (upwards) into contact with the work surface perimetrically of where abrasive is spewing forwardly from the blaster. Its toughness and integrity prevent most, if not all, of the abrasive that would otherwise escape laterally outwards from between the housing and the work surface, from so escaping. Rebounding abrasive particles which remain trapped within the perimeter of the seal fall back into the housing to be scooped up, reformed into a stream and dropped onto the rotating wheel to be again impelled against the work surface.

As the abrading process continues, not only spent abrasive drops back through the opening into the unit, but also abrasive fragments, paint chips, and dislodged scale, including oxidized metal and flaked metal. Periodically, the unit 58 is emptied of its increasingly contaminated and ineffective stock of abrasive, and recharged with a fresh stock. Or, as also described above, the abrasive grit stock of the blaster 58 can be continually replaced by effective connection with a reclaiming and recycling facility, e.g., located on the support barge 36.

The movably mounting and positioning structure of the mobile carrier 56 for the abrasive blaster 58 is shown including a rail assembly 74 which has two longitudinally extending parallel, usually generally horizontally extending rails 76 which are connected to each other at opposite ends by respective transversely extending ties 78. At each end, each tie is shown provided with a respective boss 80 which projects forwardly (upwardly) and serves as a mounting platform for a respective limit switch 82, the outer (upper) end of which, in used is located approximately in a same plane with the outer (upper) free end of the brush seal 66.

By preference, the rail end connections to the respective ties 78 are articulatable, at least to a limited extent, such that the rectangular rail assembly structure 74 can be warped or cocked in use, by individual height adjustment of the spatial location of four ends of the two ties 78, by means further described below, in order to accommodate position of the rails 74 to local spatial orientation and curvature of the surface 26 of the bottom 28 of the hull 24. (The objective is always to dispose the rails 76 so that both of them, along the entire length of each, is spaced a preselected given distance away from the surface 26. The limit switches 82 serve an important function, described below, in achieving that objective.)

The framework of the mobile carrier 56 further includes four generally upright legs 84 which collectively slope upwards and inwards towards one another like the edges of a pyramid, so as to have their lower ends disposed at corners of a longer and wider rectangle than their upper ends.

Each leg 84 incorporates between its upper and lower ends a means for individually adjustably lengthening and shortening that leg. In the preferred embodiment, that means is a remotely operable, mechanical screw jack 86. A pneumatically or hydraulically actuated extensible-contractible member could be substituted, but, for its comparatively simple construction which does not rely on continual energy input or integrity of seals to maintain a selected degree of extension, a screw jack is preferred.

Each leg 84 is shown secured, e.g., by a clevis joint 88, at its upper end to a respective end of a respective tie 78, so as to be disposed in supporting relation to the respective tie end. The clevis joints are shown having horizontal axes extending longitudinally, i.e., parallel to the rails when the rail assembly 74 is disposed horizontally without being warped.

Each leg 84 is provided at its lower end with means for rollingly supporting that end on the floor 12 of the drydock 10 while permitting that end to be controllably moved longitudinally and transversely of the ship bottom on the drydock floor. Although such an objective could be achieved by providing each lower end with a swivelable castor or a ball-shaped roller similar to the roller ball of a ballpoint pen, and for all the ends in common, a separate, orientable driver engageable with the drydock floor 12, a different construction is presently preferred, in which the structure at each lower end is separately power-rolled in a selected direction.

For that purpose, the lower end of each leg 84 has a wheeled truck 90 pivotalally secured on its lower end by a respective horizontal axis pivot joint 92 which disposes the respective truck to extend approximately horizontally, transversally of the mobile carrier 56 so as to have a medial (or inner) end and a lateral (or outer) end (both relative to the carrier 56). The lateral ends of the trucks 90 are provided with a first set of wheels 94 which, when lowered into engagement with the drydock floor 12, permit the mobile carrier 56 to be rolled transversally of the bottom 28 of the ship 14, on the floor 12 of the drydock. The medial ends of the trucks 90 are provided with a second set of wheels 96 which, when lowered into engagement with the drydock floor 12, permit the mobile carrier 56 to be rolled longitudinally of the bottom 28 of the ship 14, on the floor 12. (The locations of the two sets of wheels could be reversed from the preferred ones shown and described.)

Each leg is shown having, located directly below the respective truck pivot joint, with a respective foot tip 98. The amount of downward extension of each foot tip 98 relative to the effective diameters of the wheels 94, 96, is such that midway between pivoting of each truck 90 on its joint 92 so as to dispose one of its wheels 94 or 96 in supporting and driving engagement with the drydock floor, and so as to dispose the other of its wheels 96 or 94 in supporting and driving engagement with the drydock floor, neither wheel is so disposed, but, instead, the mobile carrier is predominately or entirely supported on the drydock floor via direct engagement of the foot tips 98 with the drydock floor 12.

The trucks 90 are shown longitudinally interconnected into first pairs by horizontal lower frame elements 100 which are coaxial with the respective pivot joints 92 and transversely into second pairs by horizontal lower frame elements 102.

The inboard set of legs 84 is rigidly braced with reference to the respective horizontal lower frame transverse elements 102, by first oblique brace struts 104, and the outboard set of legs 84 is rigidly braced with reference to the respective horizontal lower frame longitudinal elements 100, by second oblique brace struts 106.

The trucks 90 are remotely operable for pivoting about the respective joints 92 to alternatively dispose the first wheels 94, the second wheels 96, or the foot tips 98 in direct engagement with the floor 12 of the drydock, by means of an operator, which, in the preferred embodiment is shown being provided in the form of respective remotely operable mechanical screw jacks 108 which are shown extending between lower clevis connections to the respective trucks 90 distally of the respective pivot joints 92, and upper clevis connections to the respective legs 84 at vertically intermediate sites on the respective legs. In the orientations depicted, full retraction of the screw jacks 108 arrange support of the mobile carrier for movement transversely of the ship bottom, intermediate extension of the screw jacks 108 fix the location of the mobile carrier by supporting it on the foot tips 98, and full extension of the screw jacks 108 arrange support of the mobile carrier for movement longitudinally of the ship bottom.

The screw jacks 108 could be substituted by other adjusters, e.g., turnbuckles, or pneumatic or hydraulic cylinders.

The wheels 94 and 96 are powered for rotation, preferably by individual, remotely operable gear motor drives 110.

One pair of the legs, e.g., the outboard pair and its oblique braces, are shown being pivotally secured to the respective members of the lower frame by respective longitudinal, horizontal axis clevis joints 112.

Figure 2:
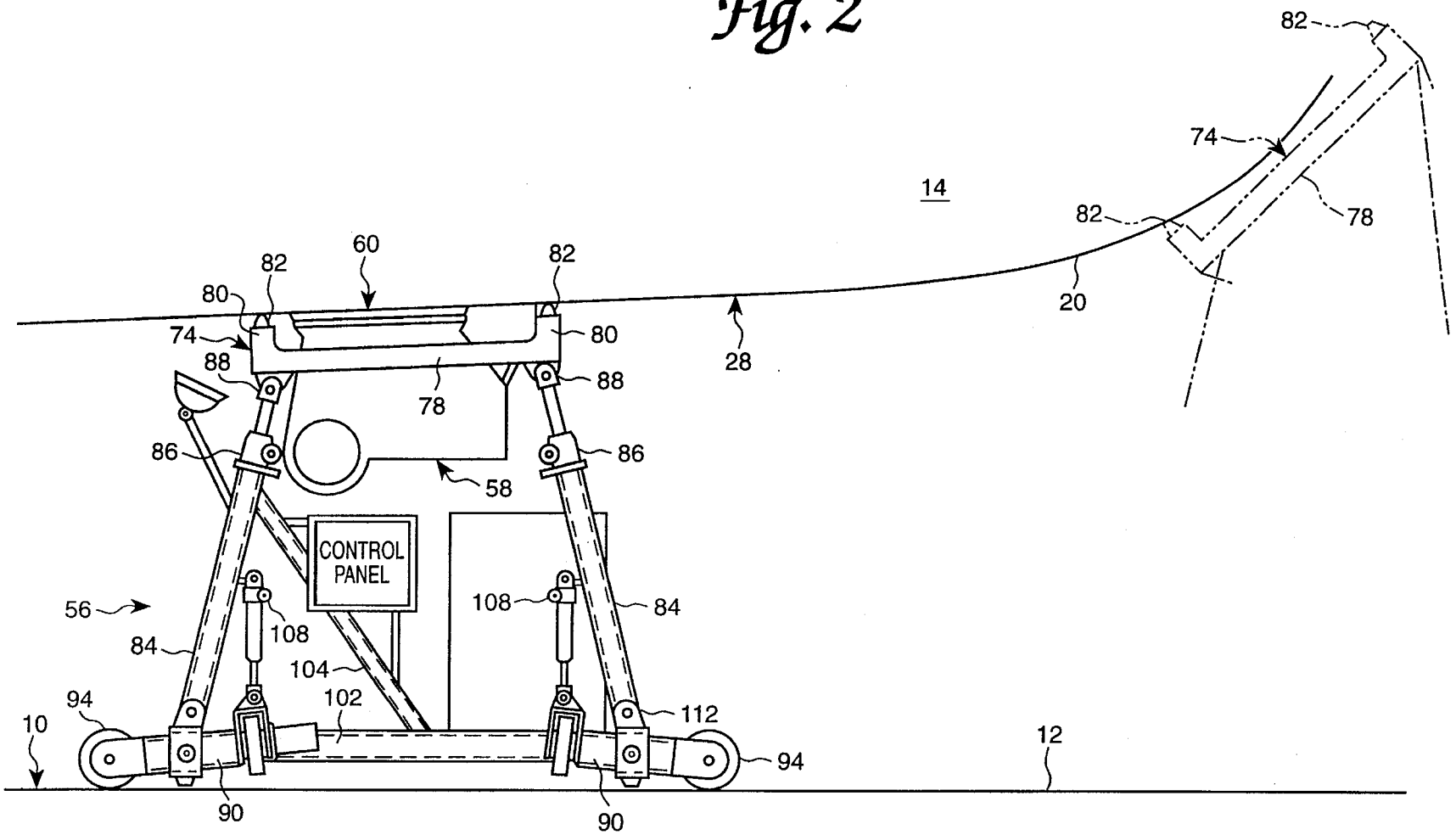
FIG. 2 is a larger scale fragmentary front elevational view of cleaning operations within the confined space, using the apparatus of the present invention.

The mobile carrier is shown in full lines in FIG. 2 at a transversely intermediate location relative to its path along the ship hull bottom, from beside the keel blocks, to the effective outer extent of its usefulness (e.g., where the rail assembly 74 becomes disposed at 45° to horizontal in order to place both rails in equal close adjacency to the hull surface 26 at the respective bilge 20.

Figure 3:
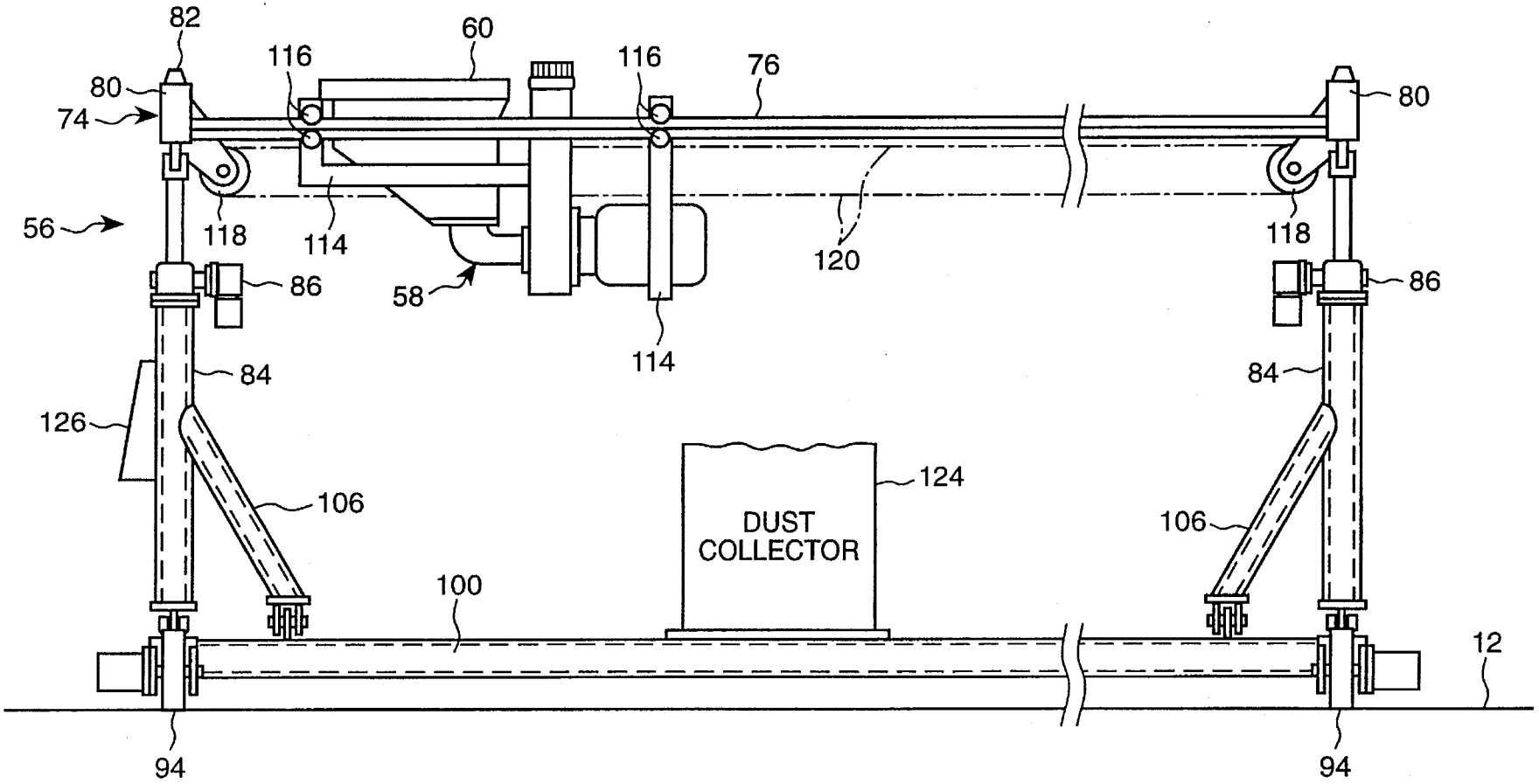
FIG. 3 is a fragmentary side elevational view thereof.
Figure 5:
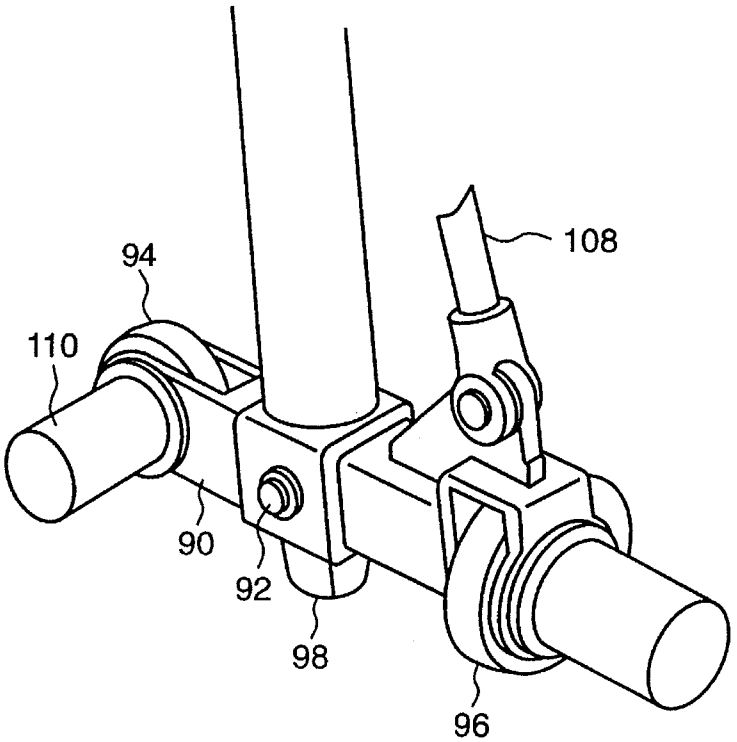
FIG. 5 is a larger scale fragmentary perspective view of what is shown in FIG. 4.
Figure 4:
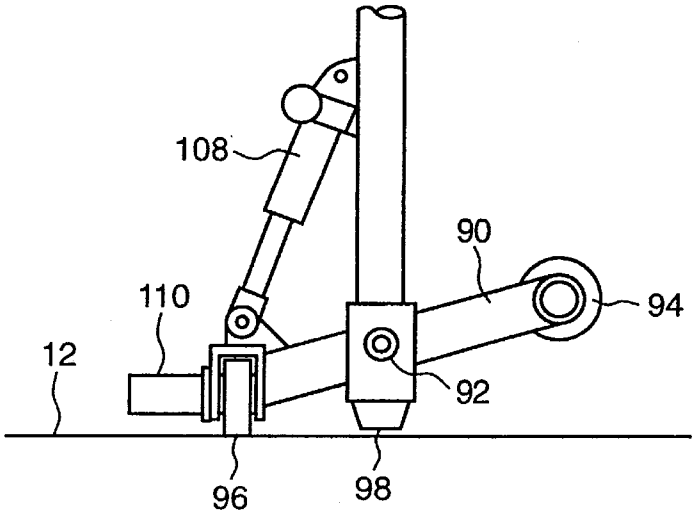
FIG. 4 is a fragmentary front elevational view of one leg of frame of the mobile carrier, showing what happens as the carrier is placed in transition from readiness for travelling in an X direction, to readiness for travelling in a Y direction.

As best shown in FIG. 3, the housing 62 of the abrasive blaster is mounted to the rails 76 for sliding or rolling support, e.g., by brackets 114 having pairs of opposed concavely grooved rollers 116 which rollingly grip the respective rails between them. Four sets of rollers 116, preferably spaced from one another as shown, are provided.

The rail ties 78 are shown further mounting respective sprockets 118 for a roller chain 120. Although the housing 62 could be physically pushed and pulled by a human operator for causing it to traverse a swath of the underside of the bottom of the hull, by preference, one of the sprockets 118 is powered by a reversible remotely operable motor, for moving the abrasive blaster at a desired speed, in a desired direction, along the underside of the bottom of the hull.

Various other items of equipment operatively associated with the abrasive blaster, e.g., a dust collector 124 and a control panel 126 for the mobile carrier 56 can be mounted on the mobile carrier, e.g., as shown in FIGS. 2 and 3.

Figure 8:
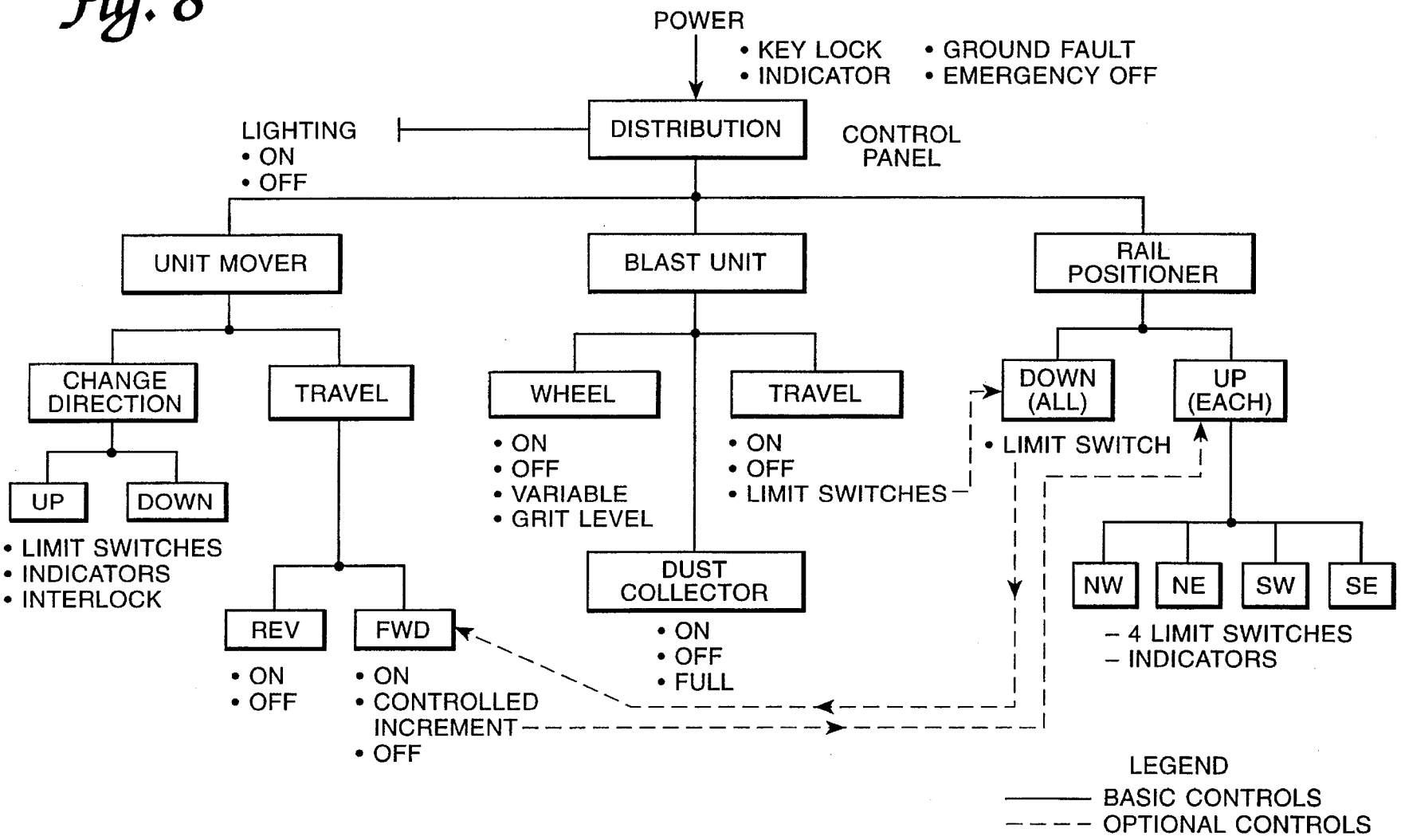
FIG. 8 is a schematic diagram of the control logic circuitry for the apparatus of FIGS. 1–7.

A preferred logic diagram for the mobile carrier 56 and its abrasive blaster is shown in FIG. 8.

Figure 9:
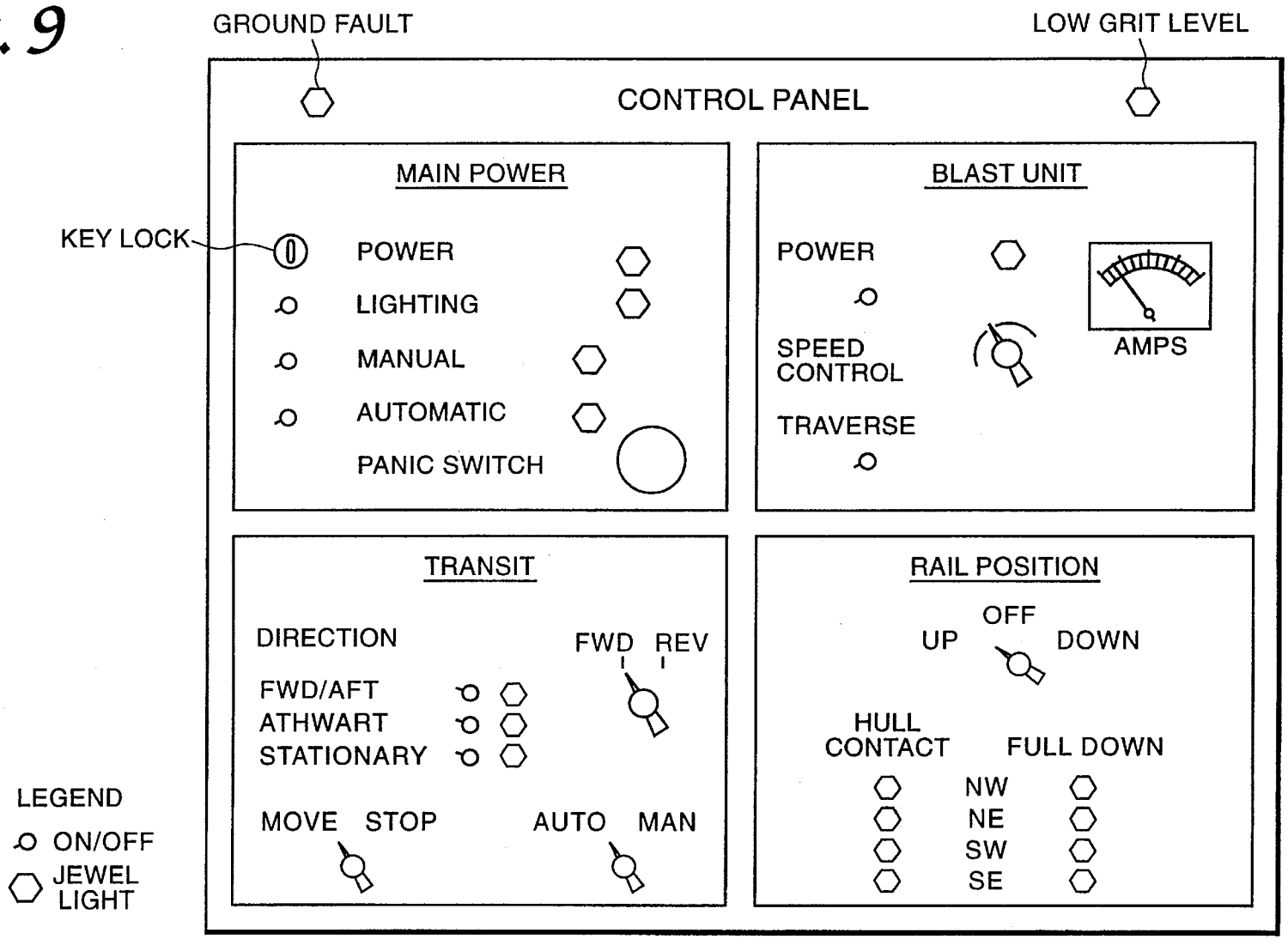
FIG. 9 is an elevational view of the control panel for the apparatus of FIGS. 1–8.

A preferred layout for the control panel 126 is shown in FIG. 9.

In the modification shown in FIGS. 10 and 11, the longitudinal elements 100 of the lower frame of the mobile carrier are given an omega-shaped jog 128 intermediate their ends, so that the carrier can straddle bilge block sliders 32. Also, in this modified embodiment, the functions of the structures 90–98 are resorted into swivelable, powered caster wheels 130, which are shown being dual wheeled.

Figure 12:
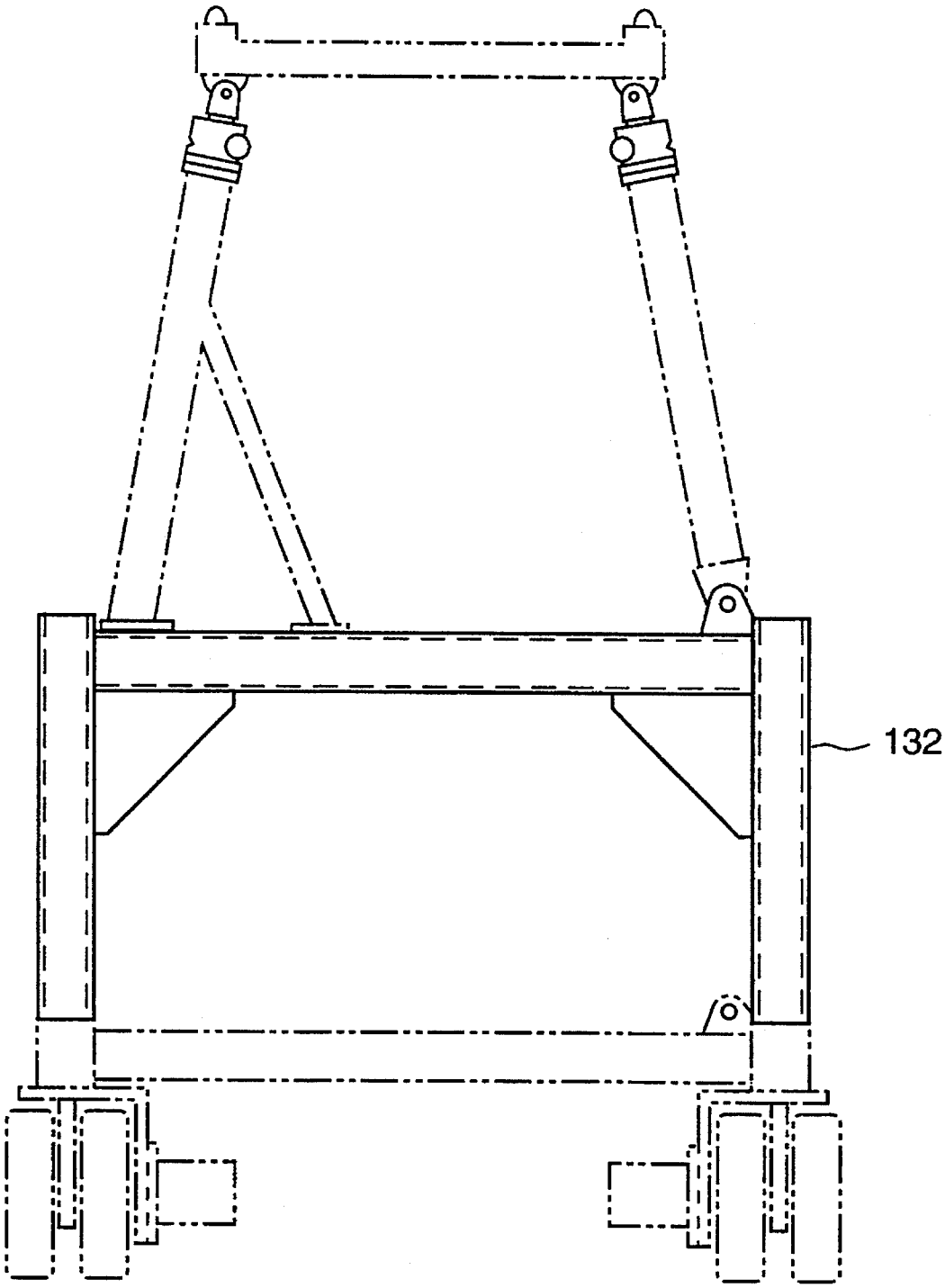
FIG. 12 shows in front elevation a modification of the frame for extending the height of the blaster support rails further upwards than can be achieved by extension of the frame leg screw jacks, i.e., to permit working on the undersides of higher-blocked ships.

In the modification shown in FIG. 12 (which is applicable to either the embodiment of FIGS. 1–9 and to the embodiment of FIGS. 10 and 11) the ability of the mobile carrier to adjustably dispose the abrasive blaster 58 higher up off the drydock floor 12 is enhanced by separating the upper and lower parts of the frame of the mobile carrier 56 or 56' from one another, and interposing a frame extension module 132, vertically between them, to which the two frame parts are functionally connected, e.g., as depicted.

In use, an increment of the underside of the ship in drydock is perimetrically cordoned off by curtaining, e.g., as described at the outset of this description, to provide a confined space delimited at its upper extent by the underside of the ship hull, and delimited at its lower extent by the drydock floor. One or more abrasive blaster-equipped mobile carriers are positioned on the drydock floor within that confined space. Each has a respective upwardly directed abrasive blaster addressing a respective site on the underside of the bottom of the hull. Supply connections are made and each mobile carrier unit is provided with electrical power service and a supply of grit for its abrasive blaster. An operator, properly outfitted with protective gear (e.g., dust-proof coverall with a respirator) is stationed at the control panel of each mobile carrier.

The support wheels of each carrier are operated to station the carrier beneath a swath of the enclosed increment of the underside of the bottom of the hull. The carrier is rendered stationary, whereupon its legs are extended until all four of its upper corner sensors make contact with the hull bottom, indicating proper standoff positioning of the rails. Next, as the abrasive blaster is operated to spew abrasive grit upwards at the underside of the hull, the abrasive blaster is advanced along the rails on the mobile carrier at least once in at least one direction (and possibly a plurality of times, including in both directions, at a desired speed, until the operator, e.g., based on visual inspection, is satisfied that the particular swath of the undersurface has become adequately clean or as clean as desired by removal of rust, scale and/or paint. The operator then stops abrasive blasting, retracts the legs, moves the mobile carrier to subadjacency with a neighboring or further swath of the confined increment of the underside of the bottom of the null, and conducts a further cleaning operation, in the manner described above.

During operation, and/or between cleaning of successive swaths, the abrasive blaster is stocked and/or restocked with abrasive grit in the manner described above.

The possibility will occur to those skilled in the art, after reading the above, that the process can be further automated to place the operator and control panel outside the confined space, with visual inspection of location and progress being made via television cameras an/or other remote sensors carried on or adjacent the mobile carriers 56.

Likewise, the possibility will occur to those skilled in the art, after reading the above, that the abrasive blaster 58 can be replaced by another work-applying device, such as a paint sprayer or a welder, for similarly carrying out other work on the underside of the ship hull. In the instance of welding, the increment of the hull underside does not necessarily need to be perimetrically sealed off by a curtain.

Further, the possibility will occur to those skilled in the art, after reading the above, that the apparatus and method could be used for applying work to the underside of something other than a ship bottom, e.g., to the underside of a bridge from a work barge located under the bridge.

It should now be apparent that the apparatus for performing external surface work on underside of ship hull as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for applying work to the downwardly facing underside surface of a structure which is located in vertically spaced confronting relation to an upwardly facing support surface, comprising:

a frame having a lower portion and an upper portion;

supports provided on the lower portion of the frame and equipping the frame to be moved in at least two orthogonally related horizontal directions along said support surface, and to be stationed as a result of such movement in directly underlying relation to each of a plurality of orthogonally related swaths of said underside surface;

a set of elongated rails vertically adjustably mounted to said upper portion of said frame for being lowered away from adjacency with said underside surface and raised into generally equally spaced sub-adjacency with said underside surface throughout respective lengths of respective rails of said set;

an upwardly facing work applicator for applying work to said underside surface;

a support structure supporting said work applicator on said set of rails for advancement along said set of rails for applying work to a succession of sites all along any selected said swath of said underside surface which has become a directly overlying swath as a result of said movement of said frame.

2. The apparatus of claim 1, wherein;

said work applicator is an abrasive blaster.

3. The apparatus of claim 2, wherein:

said abrasive blaster is one in which a supply abrasive grit is directed onto a rotating wheel so as to be centrifugally flung upward out through an opening in a housing of the abrasive blaster.

4. The apparatus of claim 3, wherein:

the housing is provided with an upwardly directed compliant seal extending parametrically of said opening, for engagement with said underside surface so as to limit literal escape of abrasive grit being flung upwardly by said abrasive blaster, abrasive grit rebounding from said underside surface, and particulate material dislodged from said underside surface by abrasive action of the abrasive grit.

5. The apparatus of claim 4, wherein:

said seal is a brush seal.

6. The apparatus of claim 4, wherein:

said seal is made of polyaramid fibers.

7. The apparatus of claim 4, wherein:

said seal is made of boron fibers.

8. The apparatus of claim 1, wherein:

said frame further includes an intermediate portion removably interposed between said upper and lower portions, for effectively height-adjusting said set of rails.

9. The apparatus of claim 1, wherein:

said supports provided on the lower portion of the frame comprise motor-driven wheels.

10. The apparatus of claim 9, wherein:

the motor-driven wheels are provided on a plurality of swivelable castors located at widely distributed corners of the lower portion of the frame.

11. The apparatus of claim 9, wherein:

the motor-driven wheels are provided in two sets, one for transverse movement and another for longitudinal movement, on adjustable trucks located at widely distributed corners of the lower portion of the frame; and further including means for selecting which of the sets is disposed in supporting relation for the carrier on the support surface.

12. The apparatus of claim 11, wherein each said corner further includes a foot tip, and said selecting means is further operable for alternatively disposing said foot tips but neither said set of wheels in said supporting relation.

13. The apparatus of claim 1, wherein:

said set of rails includes at least two generally coextensive, generally parallel rails each having two opposite ends; and said rails are vertically adjustably mounted to said upper portion of said frame by said upper portion including four vertically extensible-retractile legs having respective upper ends to which respective ends of respective ones of said rails are respectively secured.

14. The apparatus of claim 13, wherein:

said support structure includes a plurality of opposed pairs of concavely grooved rollers on a housing portion of said work applicator, each pair rollingly trapping a respective rail between them; and means for causing said rollers to roll along respective ones of said rails for moving said work applicator along said rails.

15. The apparatus of claim 14, wherein:

said means for causing said rollers to roll, is a roller chain entrained about sprockets spaced apart along said set of rails, and secured to said work applicator.

16. The apparatus of claim 15, wherein:

one of said sprockets is power rotatable by means of a drive motor operatively connected thereto.

17. The apparatus of claim 13, wherein:

said work applicator is an abrasive blaster.

18. The apparatus of claim 17, further including:

a curtain perimetrically encompassing an increment of said underside surface including a plurality of said swaths thereof, said curtain sealing between said underside surface and said support surface.

19. The apparatus of claim 1, further including:

a curtain perimetrically encompassing an increment of said underside surface including a plurality of said swaths thereof, said curtain sealing between said underside surface and said support surface.

20. A method for applying work to the downwardly facing underside surface of a structure which is located in vertically spaced confronting relation to an upwardly facing support surface, comprising:

(a) vertically and horizontally adjustably supporting an upwardly facing work applicator on an upper portion of a mobile carrier which has a lower portion that is supported on the support surface and equipped to be moved in at least two orthogonally related horizontal directions along said support surface and stationed in directly underlying relation to each of a plurality of orthogonally related swaths of said underside surface;

(b) positioning the mobile carrier directly under a selected said swath of said underside surface and vertically adjusting said upper portion to define a support and travel path for said work applicator that is generally evenly directly subadjacent said swath throughout the length of said swath;

(c) while moving said work applicator along said path, applying work upwardly therefrom to said underside surface to said swath;

(d) moving the mobile carrier along said support surface into underlying relation to another said swath;

(e) repeating steps (a)–(c) in relation to said other swath; and (f) repeating steps (d) and (e), at least one of said swaths to which work is applied being located in longitudinal contiguousness with at least another of said swaths to which work is applied and in transverse contiguousness with at least a further one of said swaths to which work is applied.

21. The method of claim 20, wherein:

said work applicator is an abrasive blaster and the work applied to said underside surface is abrasive blasting due to spewing of abrasive grit upwardly thereagainst.

22. The method of claim 21, further including:

prior to conducting step (a), peripherally enclosing an increment of said underside surface by a curtain, against the support surface, said increment including a plurality of said swaths.

23. The method claim 22, wherein:

said underside surface is the underside of a hull of a ship, and said support surface is a floor of a drydock in which the ship is supported on keel blocks and bilge blocks.

24. The method of claim 23, wherein:

in practicing step (f), the mobile carrier is sometimes rollingly moved substantially longitudinally of said structure on said support surface, for becoming positioned under a swath to be worked on which is longitudinally contiguous to a swath which has been previously worked on, and is at other times rollingly moved substantially transversally of said structure on said support surface for becoming positioned under a swath to be worked on which is transversely contiguous with a swath which has been previously worked on.

* * * * *